US005879104A

United States Patent [19]

Ulrich

[11] Patent Number: 5,879,104

[45] Date of Patent: Mar. 9, 1999

[54] SLIP-FORM PAVER FOR ROAD CONSTRUCTIONS OF CONCRETE

[75] Inventor: Alfred Ulrich, Gorxheimertal, Germany

[73] Assignee: Joseph Vogele AG., Mannheim, Germany

[21] Appl. No.: 769,686

[22] Filed: Dec. 18, 1996

[30] Foreign Application Priority Data

Dec. 19, 1995 [DE] Germany ..... 295 20 147 U

[51] Int. Cl.[6] ..... E01C 19/48

[52] U.S. Cl. ..... 404/102; 404/105; 404/110; 404/111

[58] Field of Search ..... 404/100, 101, 404/102, 104, 105, 108, 110, 114, 118

[56] References Cited

U.S. PATENT DOCUMENTS

| | | | |
|---|---|---|---|
| 4,073,592 | 2/1978 | Godberson et al. . | |
| 4,493,585 | 1/1985 | Axer | 404/102 |
| 4,759,657 | 7/1988 | Dorr | 404/118 X |
| 5,279,500 | 1/1994 | Perrin et al. | 404/75 |
| 5,405,212 | 4/1995 | Swisher et al. | 404/100 X |

FOREIGN PATENT DOCUMENTS

| | | |
|---|---|---|
| 0 217 408 A3 | 4/1987 | European Pat. Off. . |
| 2 314 812 | 10/1974 | Germany . |
| 31 14049 C3 | 10/1982 | Germany . |
| 31 17545 C1 | 11/1982 | Germany . |
| 295 14 231 | 10/1995 | Germany . |
| 295 10 058 | 11/1995 | Germany . |

*Primary Examiner*—James A. Lisehora
*Attorney, Agent, or Firm*—Finnegan, Henderson, Farabow, Garrett & Dunner, L.L.P.

[57] ABSTRACT

In a slip-form paver for road constructions of concrete, at least one transverse distribution means, at least one stripper device, one slip form and at least one concrete paving screed are arranged on a support frame, said concrete paving screed being a high-compaction paving screed which is floatingly hinged by means of at least two extension bars, which are located approximately in parallel with the base course, to pulling points of the support frame which are positioned in the traveling direction at a distance in front of the high-compaction paving screed.

17 Claims, 3 Drawing Sheets

SLIP-FORM PAVER FOR ROAD CONSTRUCTIONS OF CONCRETE

BACKGROUND OF THE INVENTION

The present invention relates to a slip-form paver.

In a slip-form paver known from DE-A-23 14 812, which is used for placing a single concrete layer, the concrete paving screed is composed of two halves which are arranged one after the other in the traveling direction and are offset relative to one another in the transverse direction and which can be transversely moved relative to one another to change the placement width. The material hopper and transverse distribution means have also an adjustable width. An adjustable width is accomplished through telescopically extensible transverse members of the support frame, from which the paving screed is suspensed at a fixed height. The concrete paving screed therefore acts as a smoothing screed which is pulled over the concrete without any significant compaction effect.

A self-propelled road finisher according to DE-U-295 14 231 is equipped with a high-compaction screed designed for placing concrete, the screed being dragged by the road finisher with lateral pulling bars and the placement thickness being variable through the inclination of the high-compaction screed (entering angle) relative to the base course.

In a road construction machine known from EP-A-0 217 408, which comprises a wheel chassis on a vehicle chassis and a paving screed trailing behind a transverse distribution device that is arranged on the chassis, bituminous or concrete pavement material is laid without any slip forms. In the operative mode the paving screed is in a floating position relative to the chassis and can be blocked hydraulically in the lifting direction and lowering direction relative to the chassis.

A finisher which is known from DE-U-295 10 058 drags, on its chassis via lateral extension arms, two or more high-compaction paving screeds which are arranged one after the other and with the aid of which concrete pavings of a monolayered or multilayerd structure can be placed.

In a slip-form paver known from U.S. Pat. No. 4,073,592, a first, forwardly open material hopper is arranged in the support frame at the front when viewed in traveling direction, and is provided with vibration means and a first transverse distribution means, and a second material hopper is integrated behind the first one and provided with vibration means and a second transverse distribution means. The first transverse distribution means has arranged therebehind a stripper device which adjusts a first concrete layer without any significant compaction effect to the desired height. A second concrete layer which is processed by a tampering device arranged downstream of the second transverse distribution means and which is finally smoothed by a smoothing screed firmly integrated into the support frame and provided with vibration means is supplied by the second material hopper and placed on the first concrete layer. The smoothing screed is divided in the traveling direction. It is possible to place two layers of concrete with this slip-form paver. However, the achievable compaction of the pavement layers is unsatisfactory.

DE-C-3 114 049 dicloses a high-compaction paving screed for bituminous mixed material wherein at least one compacting bar is provided in traveling direction behind a forwardly positioned tampering device and is vertically acted upon downwardly by drive means which generate swelling force pulses. Since the drive means which generate swelling force pulses are upwardly supported on the whole mass of the paving screed with their reaction forces resulting from the action on the compacting bar and since it is solely the swelling forces that are transmitted to the compacting bar, very high degrees of compaction can be achieved in the top layer. The high-compaction paving screed is designed for bituminous material to be exclusively used in a self-propelled road finisher without any slip form.

Slip-form pavers are used with the moving slip form that shapes the concrete laterally and on the surface to place concrete pavings (monolayered ones consisting of one concrete mixture or two-layered ones consisting of concrete mixtures having different compositions). Slip-form pavers have a serious disadvantage insofar as they lay only slightly compactable concrete and the concrete paving cannot be walked on immediately.

It is the object of the present invention to provide a slip-form paver of the above-mentioned type for placing high-quality concrete pavings that can immediately be walked on.

SUMMARY OF THE INVENTION

This object is achieved according to the invention by providing a slip-form paver (G) for road constructions of concrete, comprising a support frame (T) which is supported via chassis (3) and consists of side cheeks and connecting transverse members (2) and which has arranged thereon at least one drive unit (7), at least one material hopper (M1, M2), at least one transverse distribution means (Q1, Q2), at least one stripper device (21) and one slip form (G1, G2, G3, G'1), and comprising at least one concrete paving screed which is supported in vertically adjustable fashion on said support frame behind said transverse distribution means, characterized in that said concrete paving screed is a high-compaction paving screed (H1, H2) including slip-form members (G1, G2, G'1), and that said high-compaction paving screed (H1, H2) is floatingly hinged by means of at least two extension bars (11, 11'), located approximately in parallel with a base course (P), to pulling points (9, 9') of said support frame (T) which are located at a distance in front of said high-compaction paving screed (H1, H2).

A very highly compactable concrete mixture can be processed and can be given a constant and extremely high final compaction degree with the aid of the slip form by means of the at least one high-compaction paving screed, which has so far not been used for slip-form pavers. The placed concrete paving can immediately be walked on. It is thanks to the floating drag type support of the high-compaction paving screed in the support frame of the slip-form paver that the high-compaction paving screed can be adjusted accurately. The support frame just has to drag and guide the high-compaction paving screed and is not subject to any upwardly directed reaction forces arising from the high-compaction screed. The reaction forces which are created by compaction processes are received in the high-compaction paving screed by the great mass thereof. The high-compaction paving screed floats on the concrete layer and defines the final layer thickness through its inclination.

According to the invention, the angle of inclination of the high-compaction paving screed can be varied with respect to the desired layer thickness of the concrete.

Further, a tampering device can be provided that has a smoothing and precompacting effect while the at least one compacting bar produces the high and final compaction degree. Since the drive means which generate the swelling force pulses act on the compacting bar in a non-hammering manner, but only press it downwardly into the placed layer which is held down by the smoothing plate, forces which are higher than the weight of the high-compaction paving screed can be produced in the dynamic phase and at a correspondingly selected actuation frequency. This results in the desired high compaction degree, and it is possible to walk on the paved concrete immediately with the selected adjustment of the concrete mixture (e.g. harsh). The vibration means produce an even concrete layer surface with the smoothing plate sections.

Advantageous force transmission ratios with decoupling of the support frame from vibrations of the high-compaction paving screed can be provided by arranging the pulling points in the traveling direction in front of the transverse distribution means.

According to the invention, the constructional length can be reduced by accommodating the transverse distribution means in the discharge region of the material hopper. Standard dowels can be fixed with the aid of the dowel fixing device. However, it is also possible to omit the dowel fixing device. The stripper prepares an approximately even surface, optionally for fixing dowels. Such dowel fixing devices are known from DE-C-31 175 44 and DE-C-31 175 45.

The final quality of the concrete paving can be enhanced by providing a spray ramp for applying an adhesive to the base prior to placement of the concrete layer. On the base, the adhesive forms an absolutely tight and also highly elastic bonding course for the bond between the top layer and the base. On the other hand, the bottom layer is possibly sealed with joints, so that water, including dirt particles, can be removed from the surface of the bonding course. A bonding course is expedient for effectively connecting the relatively dry and therefore highly compactable concrete mixture, which has been placed by the high-compacting screed, to the respectively lower layer. The base may be an existing road construction, especially a road construction of concrete. The adhesive is a mixture of water, cement and additives of the most different types, e.g. also elastomers.

Since especially high demands are made on concrete paving constructions with respect to smoothness and basic roughness and since it is sometimes difficult to satisfy such demands with the floatingly operating high-compaction paving screed alone, a smoothing device is advantageously provided behind the high-compaction paving screed.

According to one embodiment of the invention, the slip-form paver has only one high-compaction paving screed for placing a highly compactable concrete layer, e.g. PCC (Paver Compacted Concrete) or drain or low-traffic-noise concrete, in WET-ON-DRY fashion on an already existing concrete road construction, namely with the help of a bonding course.

According to a further embodiment of the invention, a smoothing screed can be hung on the support frame in the conventional manner in front of the high-compaction paving screed when viewed in the traveling direction, the screed is adjusted to a specific vertical position and smoothes and vibrates the already placed bottom layer of concrete, without, however, achieving any significant final compaction. The high-compaction screed operating therebehind then places a second concrete layer with a high and final compaction degree, so that the concrete paving construction can immediately be walked on although this is a WET-ON-WET PAVEMENT.

According to the invention, the slip-form paver can place concrete grades of the same or a different quality in several layers, each of the grades being highly compactable. The bottom layer may be so-called "PCC" (Paver Compacted Concrete) which has a special mixed material composition, consisting e.g. of rock mixtures having grain sizes of from 0 to 2 (sand), 2 to 8 (gravel) and 8 to 22 (crushed material) and in the case of which a Proctor density of up to 96% can be achieved at a depth of 15 cm owing to the high-compaction paving screed. This concrete grade is harsh and easily compactable. It is also possible to place a concrete support layer consisting of B15 or B25 according to DIN 1045 at a thickness of about 15 cm with the aid of the first high-compaction paving screed in the case of a base that is sensitive to settling. The further high-compaction paving screed places the next layer on this highly compacted base, the next layer being also subjected to high compaction and optionally having the same composition or a different composition. In a very expedient embodiment a drain or low-traffic-noise concrete is placed as the top layer and the concrete is subjected to high compaction. Drain or low-traffic-noise concrete effects a very high noise reduction (approximately −5 dB(A), very good drain characteristics, i.e. no mist formation and no aquaplaning in case of traffic, high loadability at a voids contents of less than 15 percent by volume, non-skid property in the case of dry and wet road surfaces, high resistance to deformation and advantageous thermal properties (little heating up during summer).

According to the invention, a bonding course can be also applied before the second high-compaction paving screed, irrespective as to whether or not a smoothing screed or high-compaction paving screed is provided in front thereof.

According to the invention, the high-compaction paving screed can be lifted with the aid of the working cylinders into a transportation position or can be blocked in a floating position against downward lowering (upon temporary stoppage of the slip-form paver) or for adjusting the layer thickness before start of the operation. During normal operation of the slip-form paver the working cylinders are in a floating position in which they do not have any effect on movements of the high-compaction paving screed.

According to the invention, the operative width can be changed.

Further, the slip-form paver can be retrofitted in a modular manner and adapted to the respectively intended use. It can be equipped with only one single high-compaction paving screed or with two high-compaction paving screeds or with one smoothing screed at the front and a high-compaction paving screed at the rear, and with the equipment required for the respective type of screed, for which the support frame has already been prepared. The individual components which represent modular attachment units can be integrated, if desired. This effects a very universal and wide range of use for the slip-form paver.

BRIEF DESCRIPTION OF THE DRAWINGS

Embodiments of the subject matter of the invention are explained with reference to the drawings, in which.

DETAILED DESCRIPTION OF THE INVENTION

Figure 1A:
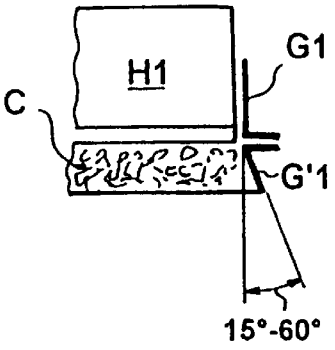
FIG. 1A is a sectional view taken along the line 1A—1A in FIG. 1.
Figure 1:
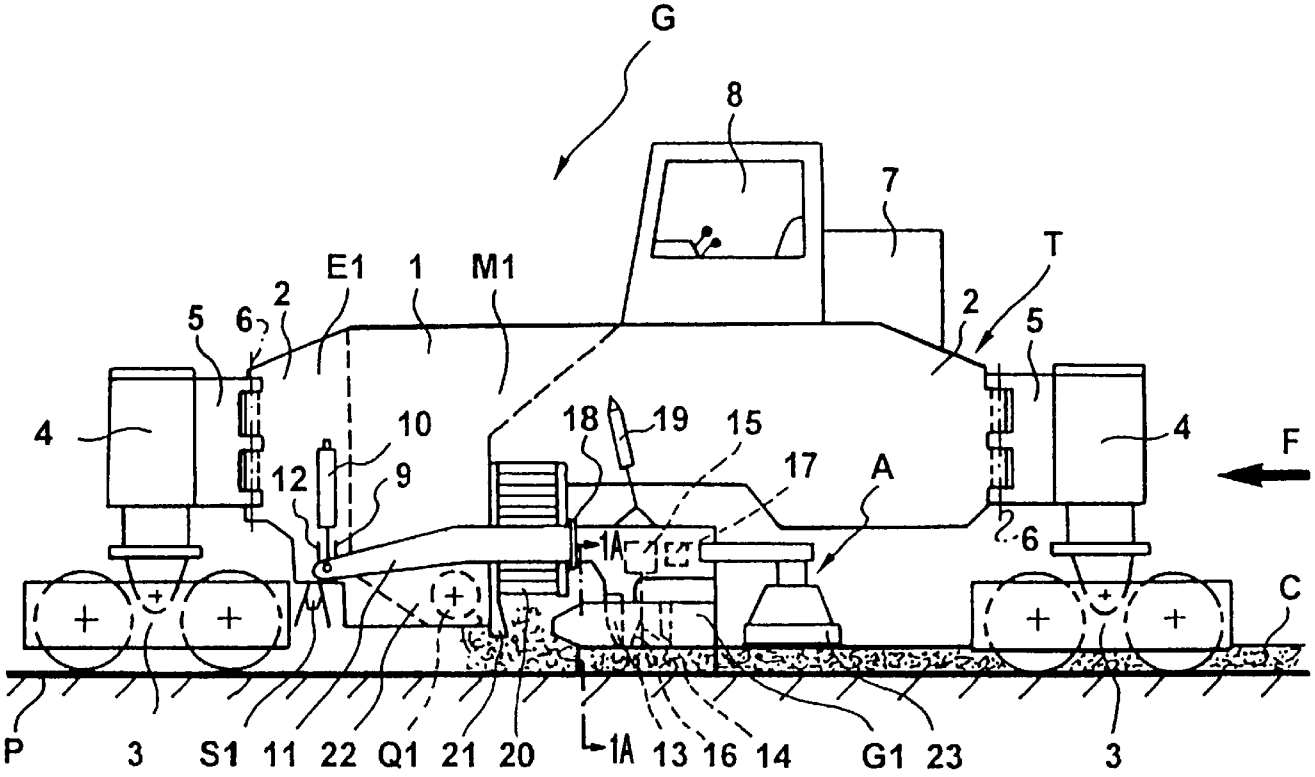
FIG. 1 is a diagrammatic lateral view of a first embodiment of a slip-form paver.
Figure 2:
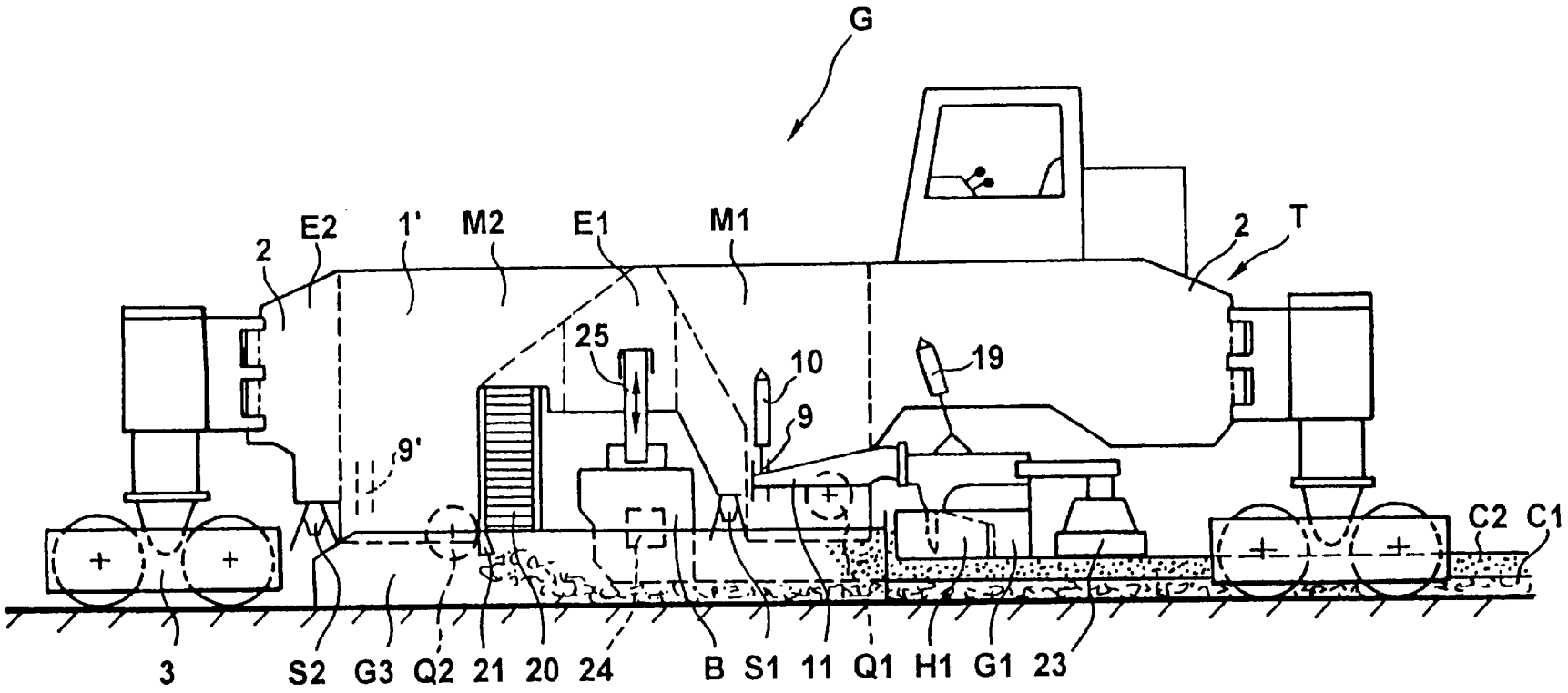
FIG. 2 is a diagrammatic lateral view of a second embodiment of a slip-form paver.
Figure 3:
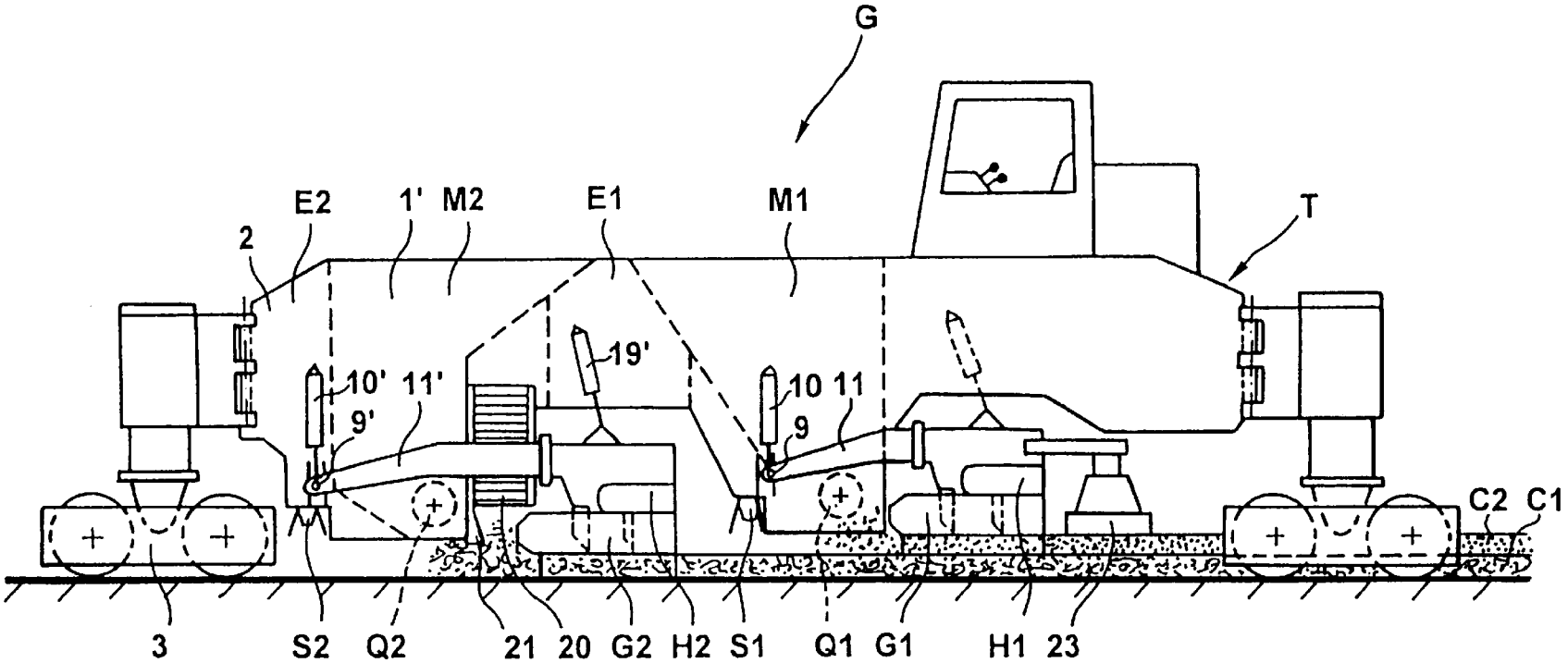
FIG. 3 shows a third embodiment of a slip-form paver.

In the embodiments of slip-form pavers G as shown in FIGS. 1 to 3, the pavers are either designed as shown and described or are made from a basic type by modular retrofitting with attachment units.

The slip-form paver G according to FIGS. 1 and 1A has an approximately rectangular support frame T consisting of side cheeks 1 and connecting transverse members 2. In support frame T, chassis 3 (wheel chassis or caterpillar chassis) are arranged to pivot about pivot axes 6 via vertically adjustable supports 4 and extension arms 5. Support frame 2 has arranged thereon a drive unit 7 (a diesel-hydraulic or diesel-electric drive unit) and also a driver's cabin or driver's cab 8. The working traveling direction is shown by arrow F.

In a front area of support frame T, each side has provided thereon a low-position pulling point 9 which is vertically adjustable by means of an actuating drive 10, e.g. a leveling cylinder. Extension bars 11 which extend in a direction opposite to the traveling direction F and are rigidly connected at 18 to a high-compaction paving screed H1 are pivotably hinged to the pulling points 9 approximately in parallel with base course P. The high-compaction paving screed H1 can thus be floatingly dragged along in the support frame T. Vertical guides 12 are provided on support frame T for pulling points 9, namely expediently on side cheeks 1.

The high-compaction paving screed H1 contains a forwardly positioned tampering device 13, smoothing plates 16 at the bottom side, and at least one transversely positioned compacting bar 14 which communicates with drive means 15 for generating swelling force pulses. There may also be contained vibration means 17 for the smoothing plates 16. Working cylinders 19 which are supported on the side cheeks 1 and serve lifting purposes, a floating position, or the initial adjustment of the high-compaction paving screed H1, act at the top on the high-compaction paving screed H1 or on the extension bars 11. The high-compaction paving screed H1 is an extension screed with an infinitely variable working width and includes external slip-form parts Gi which are formed by attached upright plates. In accordance with local rules, slip-form parts G1 may be attached to the slip-form parts G'1. These are e.g. so-called edge-beveling shaped parts for edge angles between about 15° and 60°.

A smoothing device A for the placed layer C, which in the illustrated embodiment consists of disc-shaped smoothers 23 pulled by the high-compaction paving screed H1, is provided in the working direction behind the high-compaction paving screed H1. It is possible to attach a different smoothing device or to secure the used smoothing device directly to the support frame T.

The front end portion of support frame T accommodates a material hopper M1 which in a discharge region 22 contains a transverse distribution means Q1, typically distribution augers, which place the material on the base course and distribute the same. A stripper 21 which levels the layer to a specific height is provided at a rear border wall of the material hopper M1. A dowel fixing device 20 for fixing dowels in the concrete is provided behind stripper 21. An emulsion hopper E1 is provided before the material hopper M1 for storing a liquid adhesive with the aid of which a bonding course can be produced on the ground, namely by means of a spray ramp S1 which is arranged at the bottom in the traveling direction before the discharge region 22 of the material hopper M1.

According to FIG. 2 the side cheeks 1' of the support frame T are extended in the traveling direction, e.g. by attaching a modular section to the shorter side cheeks 1 of FIG. 1. The high-compaction paving screed H1 including slip-form parts G1 (and optionally G'1) is hinged with its extension bars 11 to the pulling points 9 which are located in this embodiment in the central portion of support frame T and in the traveling direction in front of the transverse distribution means Q1 of the material hopper M1. The possibly extensible spray ramp S1 which is supplied by the emulsion container E1 with liquid adhesive and sprays the adhesive onto the base is attached at the bottom in front of the material hopper M1. The disc-shaped smoothers 23 are coupled to the high-compaction paving screed H1 which can be lifted by means of the working cylinder 19. The layer thickness can be adjusted by changing the angle of inclination of the high-compaction paving screed H1 and the smoothing plates thereof. The greater the inclination angle is, the thicker is the layer (C1, C2) placed. A stripper is optionally provided behind the transverse distribution means Q1.

A smoothing screed B which is held by means of a vertically adjustable structure 25 at the top in side cheeks 1' and in support frame T, respectively, is provided in this embodiment in the front portion of support frame T. The smoothing screed B contains a vibration means 24 and smoothes the placed concrete layer without any significant compaction effect. A second material hopper M2 is provided in support frame T in front of the smoothing screed B and a second emulsion container E2 which feeds a front spray ramp S2 with adhesive is positioned in front of the second material hopper M2. Slip-form parts G3 which can extend down to the base extend at the side of the smoothing screed B from the front end of support frame T to the high-compaction paving screed H1. As is further shown in broken line in FIG. 2, the side cheeks 1' are provided with fastening points for the front pulling points 9' either for the high-compaction paving screed H1 according to FIG. 2 or (as shown in FIG. 1) for another high-compaction paving screed. A dowel fixing device 20 with an attached stripper 21 is integrated between the front transverse distribution device Q2 of the second material hopper M2 and the smoothing screed B.

FIG. 3 differs from FIG. 2 in that instead of a smoothing screed B another high-compaction paving screed H2 is floatingly dragged by support frame T before the high-compaction paving screed H1. The further high-compaction paving screed H2 is hinged with extension bars 11' to the front pulling points 9' which are vertically adjustable by means of the actuating drives 10'. The inclination angles of the two high-compaction paving screeds H1, H2 may be different. The high-compaction paving screed H2 is also liftable and vertically adjustable by means of working cylinders 19'. The two high-compaction paving screeds H1, H2 are provided with slip-form parts G1, G2 and, optionally, G'1.

The individual components of the slip-form pavers G of FIGS. 1 to 3 may be formed as attachment units which can selectively be replaced by one another or can be installed at other points of the support frame. This concerns not only the high-compaction paving screeds H1 and H2, but also the smoothing screed B, and possibly the material hoppers, the emulsion containers, the spray ramps and also the transverse distribution means and the slip-form parts G1, G3, G'1, G2. Starting from a basic type of the support frame, slip-form pavers can be constructed for different uses. The length of the support frame can be varied by shorter or longer side cheeks 1, 1'. The side cheeks 1' may be divisible.

The high-compaction paving screeds H1, H2 and the smoothing screed B are intended to be extension screeds the placement width of which is infinitely variable. It would also be possible to enlarge the screeds by attachment parts only. The slip-form paver G is equipped with slip forms which form the lateral borders for the laid concrete layers. For the sake of simplicity the slide forms are not shown in FIGS. 1 to 3, as they are of the conventional type.

For instance, the following different concrete road constructions can be made with the aid of the slip-form pavers G of FIGS. 1 to 3:

EXAMPLE a)

With the aid of the paver G according to FIG. 1 a bonding course is applied to an existing concrete road by means of the spray ramp S1 before the subsequent placement of a highly compacted PCC or drain or low-traffic-noise concrete layer as the top concrete layer.

EXAMPLE b)

With the aid of the paver G according to FIG. 2, a bonding course is first applied to an existing concrete road construction or to a prepared base course with the aid of the spray ramp S2, and a concrete layer of conventional concrete, with a relatively damp adjustment, is then supplied by the material hopper M2 and placed. Dowels are optionally fixed with the aid of the dowel fixing device 20. A bonding course is then applied with the aid of spray ramp S1, and an upper concrete layer of PCC or of drain or low-traffic-noise concrete is then laid and subjected to high compaction. This layer is smoothed by means of the disc-shaped smoothers 23 and can immediately be walked on.

EXAMPLE c)

With paver G according to FIG. 2, an upper concrete layer of PCC or drain or low-traffic-noise concrete is supplied by the material hopper M2 and laid by means of the high-compaction paving screed H1 on the prepared base course or on an already existing concrete road construction in the raised state of smoothing screed B, a bonding course having previously been applied either with the help of the spray ramp S2 and/or spray ramp S1. It is also possible to form the upper concrete layer from material hopper M2 and to fix dowels and, optionally, not to use material hopper M1.

EXAMPLE d)

Only a conventional, non-compacted concrete layer is placed with the aid of smoothing screed B, with the high-compaction paving screed H1 of the slip-form paver G of FIG. 2 being in the lifted state due to the action of the working cylinders 19.

EXAMPLE e

A concrete road surface construction, as explained with reference to FIG. 1 (Example a)), can be formed with the aid of the slip-form paver G according to FIG. 3, with the rear high-compaction paving screed H1 being lifted into a passive position.

EXAMPLE f

A concrete road construction, as explained in Example a), can be produced with the slip-form paver G according to FIG. 3, with the high-compaction paving screed H being lifted into a passive position by the working cylinders 19'.

EXAMPLE g)

A bonding course is first sprayed with the aid of spray ramp S2 onto the prepared base course or an existing concrete paving construction with slip-form paver G according to FIG. 3. A top layer of PCC is then supplied by the material hopper M2 and placed with the aid of the high-compaction paving screed H2 and compacted. Dowels are optionally fixed with the aid of the dowel fixing device 20. Another bonding course is then sprayed with the aid of the spray ramp S1 onto this PCC layer before a top layer of drain or low-traffic-noise concrete is supplied by the material hopper M1 and laid with the aid of the high-compaction paving screed H1 and subjected to high compaction, the surface of the top layer being smoothed with the aid of the disc-shaped smoothers 23.

Although only two paving screeds that are successively arranged in the traveling direction are shown in the above-illustrated embodiments of FIGS. 2 and 3, it is possible to arrange more than two paving screeds one after the other in the support frame for placing more than two layers, i.e., together with a corresponding number of material containers, emulsion containers, transverse distribution means, and the like.

I claim:

1. A slip-form paver for constructing roads of concrete, comprising a support frame supported between a pair of chassis and having side cheeks and connecting transverse members and, arranged thereon, at least one drive unit, at least one material hopper for holding paving material, at least one transverse distribution means for placing the paving material from the hopper on a base course over which the paver travels, at least one stripper device, at least one concrete paving screed supported in a vertically adjustable manner on said support frame behind said transverse distribution means with respect to a traveling direction of said paver, wherein said concrete paving screed is a high-compaction paving screed provided with slip-form members and is floatingly hinged to said support frame by means of at least two extension bars extending rearwardly in a direction approximately in parallel with the base course, said extension bars being pivotally connected to pulling points on said support frame that are located at a distance in front of said high-compaction paving screed.

2. The slip-form paver of claim 1, wherein said pulling points are vertically adjustable by means of actuating devices and said extension bars are rigidly connected to said high-compaction paving screed.

3. The slip-form paver of claim 1, wherein said high-compaction paving screed includes a forwardly positioned tampering device with respect to the traveling direction, at least one smoothing plate on a bottom side thereof and behind the tampering device, at least one compacting bar extending in a direction transverse to the traveling direction and vertically acting drive means for generating swelling force pulses in the bar.

4. The slip-form paver of claim 1, wherein said pulling points are arranged with respect to the traveling direction in front of said transverse distribution means for said high-compaction paving screed.

5. The slip-form paver of claim 1, wherein said transverse distribution means is arranged in a lower discharge region of said material hopper and a dowel fixing device is provided behind a rear wall of said material hopper which defines said discharge region, and that the at least one stripper device is located between said transverse distribution means and said dowel fixing device.

6. The slip-form paver of claim 5, wherein an emulsion container for a liquid adhesive is provided on said support frame in front of said material hopper with respect to the traveling direction of the paver and a transversely extending spray ramp is provided for discharging said adhesive in front of said discharge region.

7. The slip-form paver of claim 1, including a smoothing device coupled with said high-compaction paving screed or said support frame, and provided behind said high-compaction paving screed with respect to the traveling direction of the paver.

8. The slip-form paver of claim 1, wherein said pulling points are arranged in a front end portion of said support frame.

9. The slip-form paver of claim 1, wherein said pulling points of said extension bars are arranged in a longitudinal center portion of said support frame, and a second material hopper including a second transverse distribution means and a smoothing screed suspended from said support frame and located behind said second transverse distribution means are arranged in a front end poritoin of the support frame and in front of the pulling points of said extension bars of said high-compaction paving screed with respect to the traveling direction of the paver so that said high-compaction paving screed is located behind said smoothing screed.

10. The slip-form paver of claim 1, wherein said pulling points of said extension bars of said high-compaction paving screed are arranged in a longitudinal center portion of said support frame and a second material hopper including a second transverse distribution means is located in a front end region of said support frame, a second high-compaction paving screed being provided that is floatingly hinged to said support frame by at least two second extension bars extending rearwardly in a direction approximately in parallel with the base course, said second extension bars being pivotally connected to second pulling points on said support frame located before said second transverse distribution means, and said second high-compaction paving screed being arranged in front of said pulling points of said at least one high-compaction paving screed with respect to the traveling direction of the paver.

11. The slip-form paver of claim 9 or 10, including an emulsion container for liquid adhesive provided on said support frame in front of each of said at least one material hopper and said second material hopper with respect to the traveling direction of the paver and a transversely extending spray ramp located in front of each hopper for discharging liquid adhesive in front of a discharge region of each hopper.

12. The slip-form paver of claim 1, including working cylinders that act from above on said high-compaction paving screed or the extension bars therefor and that are supported on said support frame above said high-compaction paving screed.

13. The slip-form paver of claim 1, wherein said high-compaction paving screed is an extension screed having an adjustable working width.

14. The slip-form paver of claim 1, wherein said transverse members of said support frame are adjustable in the transverse direction.

15. The slip-form paver of claim 1, wherein fastening means are provided on said support frame for the selective attachment of the high-compaction paving screed.

16. The slip-form paver of claim 1, wherein said side cheeks of said support frame are each composed of at least two separable modular sections.

17. The slip-form paver of claim 1, wherein said cheeks are selectively interconnected in said support frame by said transverse members.

* * * * *